US007862308B1

(12) United States Patent
Leung

(10) Patent No.: US 7,862,308 B1
(45) Date of Patent: Jan. 4, 2011

(54) ROTARY RECIPROCATING PUMP

(76) Inventor: Alex S. Y. Leung, 3404, 24'th St. NW, Calgary, Alberta (CA) T2L 0Y3

( * ) Notice: Subject to any disclaimer, the term of this patent is extended or adjusted under 35 U.S.C. 154(b) by 1080 days.

(21) Appl. No.: 11/601,929

(22) Filed: Nov. 20, 2006

(51) Int. Cl.
*F01B 13/04* (2006.01)
*F04B 1/22* (2006.01)

(52) U.S. Cl. ..... 417/269; 91/502; 417/255; 417/522; 92/57

(58) Field of Classification Search ..... 91/499, 91/502; 417/255, 372, 522; 92/57, 71, DIG. 2, 92/269, 533, 534
See application file for complete search history.

(56) References Cited

U.S. PATENT DOCUMENTS 5,636,561 A * 6/1997 Pecorari ..... 91/499

* cited by examiner

*Primary Examiner*—Devon C Kramer
*Assistant Examiner*—Philip Stimpert
(74) *Attorney, Agent, or Firm*—G. F. Gallinger

(57) ABSTRACT

A rotary reciprocating pump comprises: i) a pump housing having intake and discharge ports; a shaft driven rotary piston carder, rotatably carrying pistons circularly arranged therearound; ii) a driven rotary cylinder block having a plurality of cylinder bores therein, circularly arranged therearound for reception of the pistons, and having a flat outer side portion having an intake/discharge port therethrough communicating with the cylinder bores; iii) a stationary sloping inner control surface portion in sliding proximity with the outer side portion of the rotating cylinder block, the control surface portion configured so that the cylinder block moves outwardly for intake and inwardly for discharge, the control surface portion also having grooved openings therethrough to appropriately communicate with the ports to the bore through the cylinder block and with the intake and discharge ports in the pump housing; and, iv) a spring biasing the cylinder blocks towards the control surface portion.

19 Claims, 3 Drawing Sheets

ROTARY RECIPROCATING PUMP

FIELD OF THE INVENTION

This invention relates to piston pumps used to pump light oils and water. More particularly this invention relates to a high capacity piston pump which rotates at a relatively high speed. The pump performs with the high efficiency of a piston pump but has the higher volumetric capacity associated with its high speed rotation. The pump comprises a relatively narrow diameter which facilitates positioning within a well bore.

BACKGROUND OF THE INVENTION

Reciprocating pumps, as contrasted to centrifugal pumps, are relatively efficient. There is considerably less slippage around a piston than about the rotor of a centrifugal pump. Reciprocating pumps however, are characterized by low volumetric capacity which is associated with the relatively slow reciprocation of the pistons. What is needed is a pump having the high flow rate of a centrifugal pump, but also having the high efficiency of a reciprocating pump.

OBJECTS OF THE INVENTION

It is an object of this invention to disclose a rotary reciprocating pump which has the flow capacity of a rotary pump but which also has the efficiency of a reciprocating pump. It is an object of this invention to disclose a pump having multiple pistons positioned in lateral alignment with similar pistons which are moving in opposed directions so that thrust between the opposed pistons is balanced. It is an object of this invention to disclose a pump which utilizes discharge pressure to maintain the piston rods in tension and thereby facilitate alignment of the pistons within the cylinder block. It is yet a further object of this invention to disclose a pump having an relatively minimal diameter which facilities positioning within a well bore. It is a final object of this invention to disclose a pump having a housing which facilites interconnection of a plurality of pumps together to increase flow and facilitate use of a single motor to drive all of the interconnected pumps.

One aspect of this invention provides for a rotary reciprocating pump comprises: i) a pump housing having intake and discharge ports; a shaft driven rotary piston carrier, rotatably carrying a first set of pistons circularly arranged therearound, said pistons extending from a first side thereof; a driven rotary cylinder block having a plurality of cylinder bores therein, circularly arranged therearound for reception of the pistons on one side portion thereof, and having an opposite flat outer side portion having an intake/discharge port therethrough communicating with the cylinder bores; a driven rotary cylinder block having a plurality of cylinder bores therein, circularly arranged therearound for reception of the pistons on one side portion thereof, and having an opposite flat outer side portion having an intake/discharge port therethrough communicating with the cylinder bores; iii) a stationary sloping inner control surface portion in sliding proximity with the outer side portion of the rotating cylinder block, one peripheral portion of the control surface portion configured so that the cylinder block in proximity therewith moves outwardly, away from the piston for intake, and another opposite peripheral portion of the control surface portion configured so that the rotating cylinder block moves inwardly towards the piston, so that the piston bottoms in the bore for discharge, said control surface portion also having grooved openings therethrough to appropriately communicate with the ports to the bore through the cylinder block, said grooved openings also appropriately communicating with intake and discharge ports in the pump housing; and, iv) a bias means outwardly biasing said cylinder blocks away from the pistons towards the control surface portion.

In a preferred aspect of this invention the pump further comprises a second set of pistons extending from a second opposite side of the piston carrier, a second driven cylinder block surrounding the additional pistons, and a second stationary sloping inner control surface portion in sliding proximity with the outer side portion of the rotating cylinder block, so that forces generally in axial alignment and associated with the first set of pistons are opposed by forces associated with the second set of pistons.

In yet another preferred aspect of this invention the pump further comprises a discharge pressure manifold fully surrounding the piston carrier and the pistons within the pump housing so that the discharge fluid pressure is maintained on a rod side of the piston, and thereby, the piston rods are generally held in tension and thereby self align within the cylinder blocks.

Various other objects, advantages and features of this invention will become apparent to those skilled in the art from the following description in conjunction with the accompanying drawings.

FIGURES OF THE INVENTION

Figure 8:
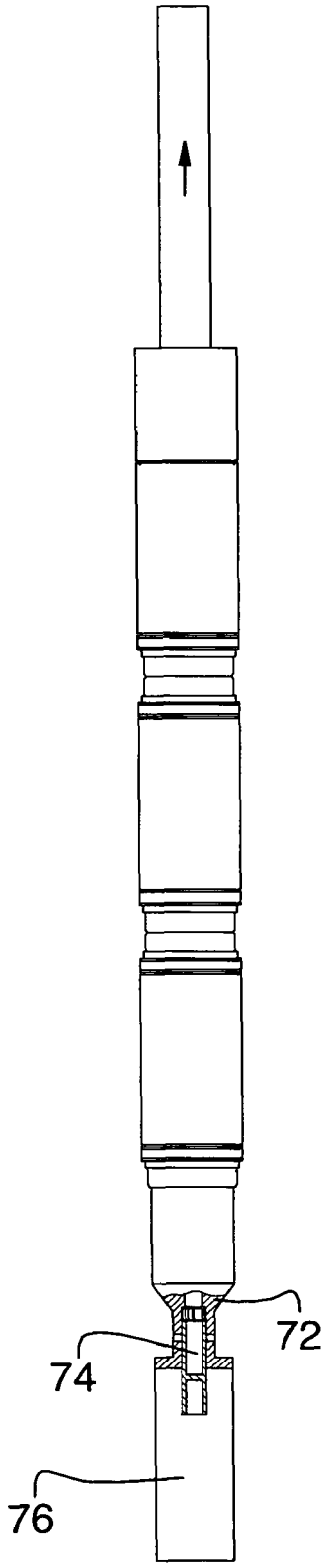

FIG. 8 shows three pumps serially arranged for insertion within a well bore. A motor positioned below the pumps directly drives the pump shafts. The pumps discharge upwardly from a top side portion.

The following is a discussion and description of the preferred specific embodiments of this invention, such being made with reference to the drawings, wherein the same reference numerals are used to indicate the same or similar parts and/or structure. It should be noted that such discussion and description is not meant to unduly limit the scope of the invention.

DESCRIPTION OF THE INVENTION

Figure 1:
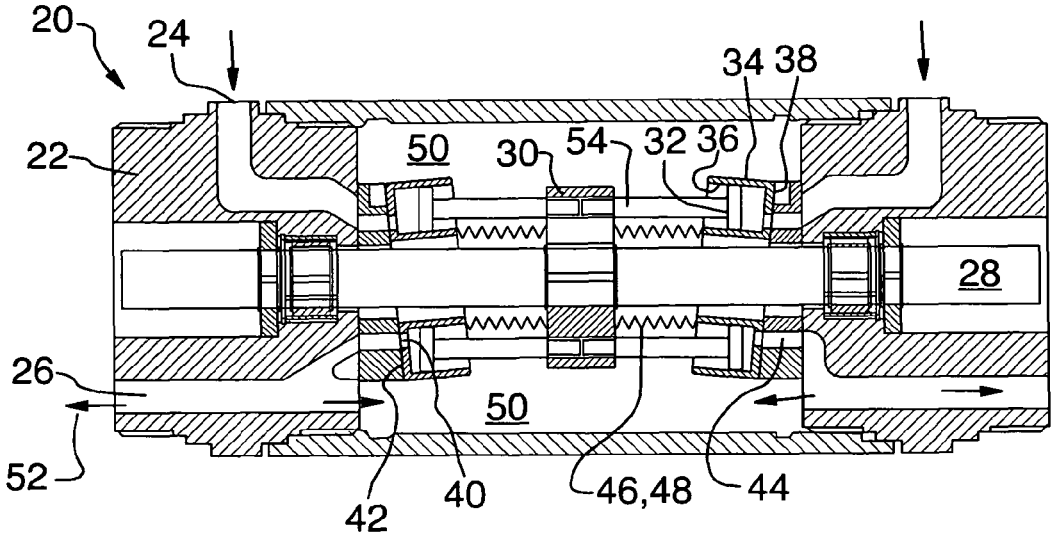
FIG. 1 is a cross sectional view of a rotary reciprocating pump.

Turning now to the drawings and more particularly to FIG. 1 we have a cross sectional view of a rotary reciprocating pump 20. Most generally a rotary reciprocating pump 20 comprises: i) a pump housing 22 having intake ports 24 and discharge ports 26; a shaft 28 driven rotary piston carrier 30, rotatably carrying a first set of pistons 32 circularly arranged therearound, said pistons 32 extending from a first side thereof; ii) a driven rotary cylinder block 34 having a plurality of cylinder bores 36 therein, circularly arranged therearound for reception of the pistons 32 on one side portion thereof, and having an opposite flat outer side portion 38 having an intake/discharge port 40 therethrough communicating with the cylinder bores 36; iii) a stationary sloping inner control surface 42 portion in sliding proximity with the outer side portion of the rotating cylinder block 34, one peripheral portion of the control surface portion 42 configured so that the cylinder block 34 in proximity therewith moves outwardly, away from the piston 32 for intake, and another opposite peripheral portion of the control surface portion 42 configured so that the rotating cylinder block 34 moves inwardly towards the piston 32, so that the piston 32 bottoms in the bore 36 for discharge, said control surface portion 42 also having grooved openings 44 therethrough to appropriately communicate with the ports 40 to the bore through the cylinder block 34, said grooved openings 44 also appropriately communicating with intake and discharge ports 40 in the pump housing 22; and, iv) a bias means 46 outwardly biasing said cylinder blocks 34 away from the pistons 32 towards the control surface portion 42. Most preferably the bias means 46 comprises a spring 48.

It should be noted that the above design which utilizes springs 48 to urge the cylinder block 50 into sliding contact with the control surface portion 42 minimizes particulate damage within the cylinder block 34. When a particle is initially trapped between the piston 32 and an interior of the bore 36, the spring 48 may remain compressed so that further movement of the piston 32 within the bore 36 need not occur until such time as the particle becomes dislodged.

In the most preferred embodiment of the invention the pump 20 further comprises a second set of pistons 32 extending from a second opposite side of the piston carrier 30, a second driven cylinder block 34 surrounding the additional pistons 32, and a second stationary sloping inner control surface portion 42 in sliding proximity with the outer side portion of the rotating cylinder block 34, so that forces generally in axial alignment and associated with the first set of pistons 32 are opposed by forces associated with the second set of pistons 32. Most preferably the exterior of the housing 22 is generally cylindrical to facilitate use of the pump 20 within a well bore. Most preferably the pump 20 further comprising a discharge pressure manifold 50 fully surrounding the piston carrier 30 and the pistons 32 within the pump housing 22 so that the discharge fluid 52 pressure is maintained on a rod 54 side of the piston 32, and thereby, the piston rods 54 are generally held in tension and thereby self align within the cylinder blocks 34.

Figure 2A:
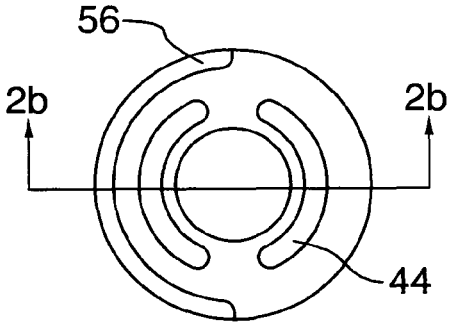
FIG. 2 is a side view of the control surface portion shown in FIG. 1.
FIG. 2*b* is a cross section of the control surface portion as viewed along line 2*b*-2*b* in FIG. 2.
Figure 2B:
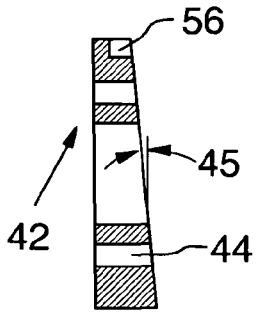

FIG. 2 is a side view of the control surface portion shown in FIG. 1. Most preferably the control surface portion 42 is not integral with, and manufactured separately from the housing 22. FIG. 2 best shows that the most preferred angle 45 of the sloping control surface portion which is just less than 5 degrees. When the angle of the control surface portion 42 is less than 5 degrees the forces acting on the piston 32 are essentially in tension, and the number of bearings needed about the piston 32 are minimized. FIG. 2 also best shows the arrangement of the grooved openings 44 through the control surface portion 42. FIG. 2*b* is a cross section of the control surface portion 42 as viewed along line 2*b* in FIG. 2. In the most preferred embodiment of the invention the control surface portion further comprises a cutout 56 within the control surface which is in communication with the discharge pressure manifold 50 so that pressure exerted by the discharge fluid 52 will balance pressure on the control surface portion 42 exerted by the cylinder block 34. In the most preferred embodiment of the invention the surface area of the cutout 56 in the control surface portion 42 is sized so that the fluid 52 forces acting on the cylinder block 34 are balanced.

Figure 3A:
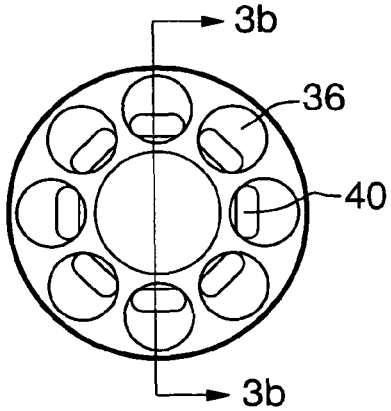
FIG. 3 is a front view of the cylinder block shown in FIG. 1.
FIG. 3*b* is a cross sectional view of the cylinder block as viewed along line 3*b*-3*b* in FIG. 3.
Figure 3B:
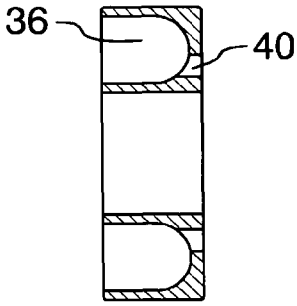

FIG. 3 is a front view of the cylinder block shown in FIG. 1. FIG. 3*b* is a cross sectional view of the cylinder block 34 as viewed along line 3*b*-3*b* in FIG. 3. FIGS. 3 and 3*b* have been included to ensure a better understanding of the cylinder block 34.

Figure 4:
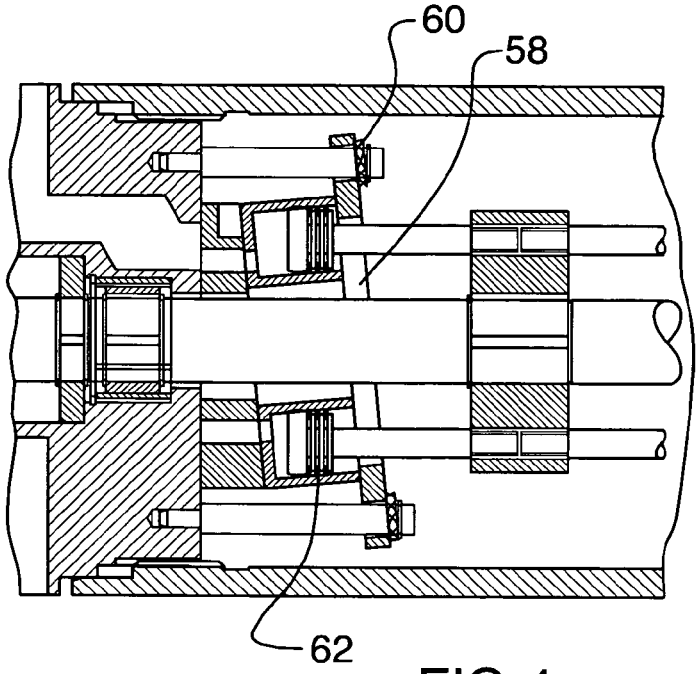
FIG. 4 is a partial cross sectional view similar to that shown in FIG. 1 but further comprising a spring plate and pistons having piston rings.

FIG. 4 is a partial cross sectional view similar to that shown in FIG. 1 but further comprising a spring plate 58 and pistons 32 having piston rings 62. FIG. 4 best shows an embodiment of the invention where the piston 32 has a rod 54 which is threaded into the piston carrier 30. The spring plate 58, through weave spring 60 maintains the cylinder block in close proximity to the control surface portion 42. FIG. 4 also shows a preferred embodiment of the invention further comprising piston rings to reduce fluid flow between the piston and cylinder block.

Figure 5:
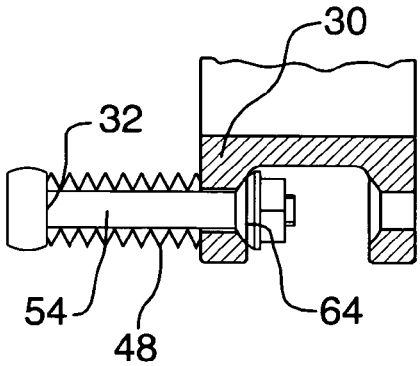
FIG. 5 is a cross sectional view showing an alternative arrangement wherein the pistons are carried on the piston carrier with a gimbal to facilitate limited rotational movement therein.
Figure 6:
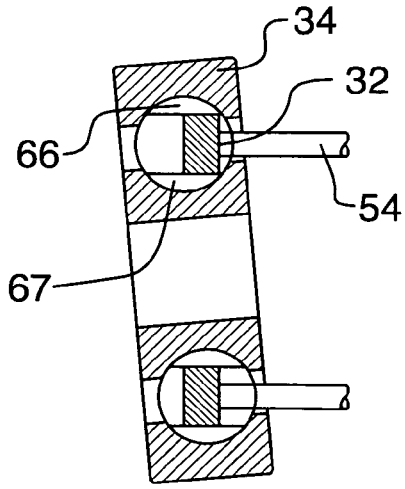
FIG. 6 is a cross sectional view showing an alternative arrangement wherein the cylinder block further comprises large bearings each having a cylindrical bore therethrough to receive the pistons therein.

FIG. 5 is a cross sectional view showing an alternative arrangement wherein the pistons 32 are carried on the piston carrier 30 with a gimbal 64 to facilitate limited rotational movement therein. The pistons 32 have a rod 54 which utilizes a gimbal 64 for limited rotatable connection within the piston carrier 30. FIG. 5 also shows a preferred arrangement wherein the pistons 32 are individually spring 48 loaded so that if a particular piston 32 becomes clogged (and stuck) the other pistons 32 can continue working. FIG. 6 is a cross sectional view showing an alternative arrangement wherein the cylinder block 34 further comprises large bearings 66 each having a cylindrical bore 67 therethrough to receive the pistons 32 therein. The pistons 32 are received by a swivelling bearing 66 within the cylinder bore 34. To accommodate the sloped control surface portion the piston rods 54 may be made of a flexible material to thereby facilitate alignment of the piston 32 within the cylinder block 34.

Figure 7:
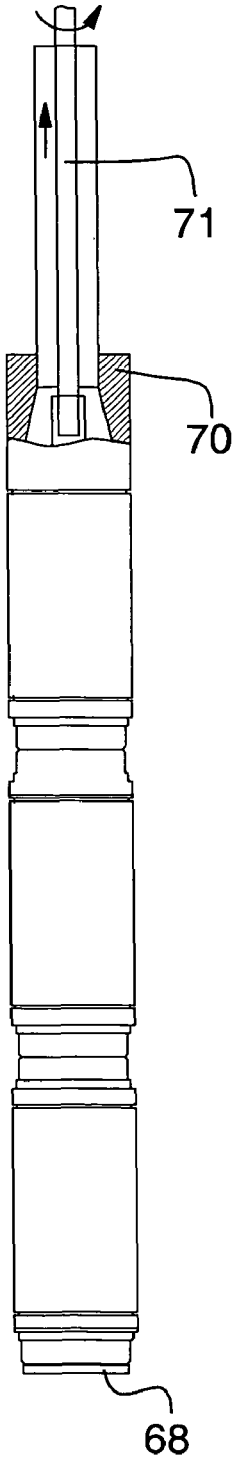
FIG. 7 shows three pumps serially arranged for insertion within a well bore. The pumps are driven and discharge out a top end portion.

FIG. 7 shows three pumps 20 interconnected for insertion within a well bore. The pumps 20 are driven and discharge out a top end portion. An end plate 68 to completely close off one end portion of the pump is provided. Additionally, a discharge adapter 70 is provided to centrally discharge fluid 52 from an opposite end portion of the pump 20 around a drive 71 shaft connected thereto. FIG. 8 shows three pumps 20 interconnected for insertion within a well bore. A motor 76 is positioned below the pumps 20 directly driving the pump shafts 28. The pumps 20 discharge upwardly from a top side portion. A motor adapter 74 is provided to close off discharge from a bottom end portion of the pumps 20 while surrounding the drive shaft 74 of the motor 76 attached to the motor adaptor 74. The pump housing 22, the pump discharge outlets 26 and pump shafts 28 are configured so that similar pumps 20 may be interconnected, end to end, for increased flow capacity. Interconnection of the pumps 20 also facilitates the interconnected pumps 20 being driven by a single motor 76.

While the invention has been described with preferred specific embodiments thereof, it will be understood that this description is intended to illustrate and not to limit the scope of the invention, which is defined by the following claims.

I claim:

1. A rotary reciprocating pump comprising:

i) a pump housing having intake and discharge ports;

a shaft driven rotary piston carrier, rotatably carrying a first set of pistons circularly arranged therearound, said pistons extending from a first side thereof;

ii) a driven rotary cylinder block having a plurality of cylinder bores therein, circularly arranged therearound for reception of the pistons on one side portion thereof, and having an opposite flat outer side portion having an intake/discharge port therethrough communicating with the cylinder bores;

iii) a stationary sloping inner control surface portion in sliding proximity with the outer side portion of the rotating cylinder block, one peripheral portion of the control surface portion configured so that the cylinder block in proximity therewith moves outwardly, away from the piston for intake, and another opposite peripheral portion of the control surface portion configured so that the rotating cylinder block moves inwardly towards the piston, so that the piston bottoms in the bore for discharge, said control surface portion also having grooved openings therethrough to appropriately communicate with the ports to the bore through the cylinder block, said grooved openings also appropriately communicating with intake and discharge ports in the pump housing;

iv) a bias means outwardly biasing said cylinder block away from the pistons towards the control surface portion; and v) a discharge pressure manifold full surround the piston carrier and the pistons within the pump housing so that the discharge fluid pressure is maintained on a rod side of the piston, and thereby, the piston rods are generally held in tension and thereby self align within the cylinder blocks.

2. A pump as in claim 1 further comprising a second set of pistons extending from a second opposite side of the piston carrier, a second driven cylinder block surrounding the additional pistons, and a second stationary sloping inner control surface portion in sliding proximity with the outer side portion of the rotating cylinder blocks, so that forces generally in axial alignment and associated with the first set of pistons are opposed by forces associated with the second set of pistons.

3. A pump as in claim 2 wherein the exterior of the housing is generally cylindrical to facilitate use of the pump within a well bore.

4. A pump as in claim 2 wherein the control surface portions are not integral with, and is manufactured separately from the housing.

5. A pump as in claim 1 wherein the sloping inner control surface portion has less than a 15 degree slope from a plane normal to the axis of rotation of the piston carrier.

6. A pump as in claim 3 wherein the sloping inner control surface portion has less than a 10 degree slope from a plane normal to the axis of rotation of the piston carrier.

7. A pump as in claim 6 wherein the sloping inner control surface portion has less than a 5 degree slope a plane normal to the axis of rotation of the piston carrier.

8. A pump as in claim 5 further comprising a cutout within the control surface which is in communication with the discharge pressure manifold so that pressure exerted by the discharge fluid will balance pressure on the control surface portion exerted by the cylinder block.

9. A pump as in claim 8 wherein the surface area of the cutout in the control surface portion is sized so that the fluid forces acting on the cylinder block are balanced.

10. A pump as in claim 1 wherein the piston has a rod which is threaded into the piston carrier.

11. A pump as in claim 1 further comprising a spring plate which maintains the cylinder block in close proximity to the control surface portion.

12. A pump as in claim 1 further comprising piston rings to reduce fluid flow between the piston and cylinder block.

13. A pump as in claim 1 wherein the pistons have a rod which utilizes a gimbal for limited rotatable connection within the piston carrier.

14. A pump as in claim 1 wherein the pistons are individually spring loaded so that if a particular piston becomes clogged the other pistons can continue working.

15. A pump as in claim 1 wherein the pistons are carried by a swiveling beating within the piston carrier.

16. A pump as in claim 1 wherein the piston rods are made of a flexible material to facilitate alignment of the piston within the cylinder block.

17. A pump as in claim 2 further comprising an end plate to completely close off one end portion of the pump; and a discharge adapter to centrally discharge fluid from an opposite end portion of the pump around a drive shaft connected thereto.

18. A pump as in claim 2 further comprising a motor adapter to close of discharge from a bottom end portion of the pumps while surrounding the drive shaft of a motor attached to the motor adaptor.

19. A pump as in claim 1 wherein the pump housing, the pump discharge outlets and shafts are configured so that similar pumps may be interconnected, end to end, for increased flow capacity and/or increased pressure.

* * * * *